US005244489A

United States Patent [19]

Grenier

[11] Patent Number: 5,244,489

[45] Date of Patent: Sep. 14, 1993

[54] PROCESS FOR SUPPLYING A BLAST FURNACE WITH AIR ENRICHED IN OXYGEN, AND CORRESPONDING INSTALLATION FOR THE REDUCTION OF IRON ORE

[75] Inventor: Maurice Grenier, Paris, France

[73] Assignee: L'Air Liquide, Societe Anonyme pour l'etude et l'exploitation des Procedes Georges Claude, Paris, France

[21] Appl. No.: 895,711

[22] Filed: Jun. 9, 1992

[30] Foreign Application Priority Data

Jun. 12, 1991 [FR] France ..... 91 07161

[51] Int. Cl.[5] ..... C21B 9/00; C21B 5/00

[52] U.S. Cl. ..... 75/466; 266/141; 266/160

[58] Field of Search ..... 266/141, 160; 75/466

[56] References Cited

U.S. PATENT DOCUMENTS 3,304,074 2/1967 Atherton ..... 75/466
4,022,030 5/1977 Brugerolle ..... 62/32

FOREIGN PATENT DOCUMENTS 0206493 12/1986 European Pat. Off. .
890211 2/1944 France .
61-139609 6/1986 Japan .

*Primary Examiner*—Melvyn J. Andrews
*Attorney, Agent, or Firm*—Young & Thompson

[57] ABSTRACT

There is produced by an air distillation apparatus (4) a desired fraction of air from the stream of air leaving at least one blower (3) of the blast furnace, and there is sent to the blast furnace the oxygen produced by this distillation apparatus. The distillation apparatus comprises an air/liquid oxygen mixing column which operates at about 1 bar above the delivery pressure of the blower (3) and which directly produces the oxygen for enriching the air.

10 Claims, 2 Drawing Sheets

Figure 1:
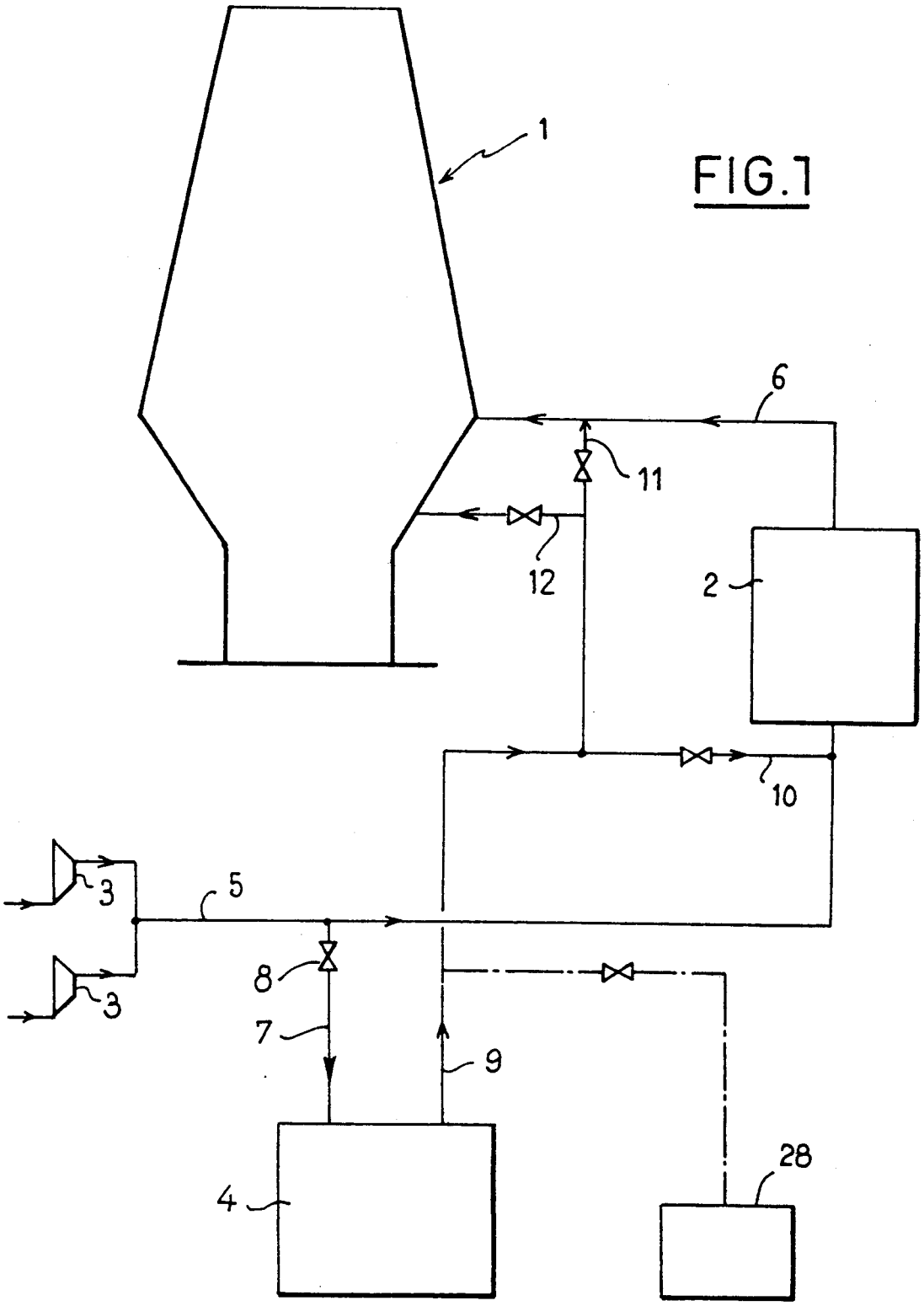

PROCESS FOR SUPPLYING A BLAST FURNACE WITH AIR ENRICHED IN OXYGEN, AND CORRESPONDING INSTALLATION FOR THE REDUCTION OF IRON ORE

The present invention relates to the supply of blast furnaces with air enriched in oxygen. It concerns in the first instance a process for supplying a blast furnace with air enriched in oxygen, of the type in which there is diverted to an air separation apparatus a desired fraction of the air flow leaving at least one blower of the blast furnace, and there is sent to the blast furnace the oxygen produced by this separation apparatus.

The use of enriched air in blast furnaces permits reducing the consumption of coke by the addition of combustibles such as natural gas, fuel or powdered charcoal. Various processes have been proposed to operate blast furnaces with enriched air of medium oxygen content comprised between 30 and 95%.

According to the known solutions, to enrich the air, there is separately produced pure oxygen, generally of a purity of about 85 to 95%, and this oxygen is injected either upstream of the blast furnace blower, if the enriched air content is not greater than 30%, or, in other cases, into the air injected in the blast furnace or directly into the specified tuyeres.

A more flexible and rational solution consists in using a process of the above type. JP-A-139 609/1986 discloses such a process, in which the produced oxygen is conveyed by aspiration of the blower. This document also provides introducing this oxygen to the output of the blower, but without disclosing economical means to do this.

The invention has for its object to provide a particularly flexible and economical process for supplying a blast furnace with enriched air of variable content, in which the oxygen produced by the separation apparatus is directly available at the necessary pressure for its utilization in the blast furnace.

To this end, the invention has for its object a process of the recited type, characterized in that there is used as air separation apparatus an apparatus for the distillation of air comprising a mixing column operating under a higher pressure, particularly by about 1 bar, than the delivery pressure of the blower, this mixing column being supplied at its head with liquid oxygen and at its base with air, the overhead gas of this column constituting said oxygen.

According to other characteristics:

the air sent to the mixing column is supercharged by means of an auxiliary blower driven by a cooling turbine of the distillation apparatus;

the distillation column of the distillation apparatus, which operates at the highest pressure, is supplied with said air fraction at the output pressure of the blast furnace blower;

at least one portion of the oxygen produced by the separation apparatus is mixed with the undiverted air fraction, either upstream or downstream of the air preheating apparatus of the blast furnace;

at least a portion of the oxygen produced by the air separation apparatus is sent directly to the blast furnace.

The invention also has for its object an installation for the reduction of iron ore adapted to use such a process. This installation, of the type comprising a blast furnace, at least one blower for feeding air to this latter, an air separation apparatus disposed in a detour of the output conduit of the blower, and an enriching conduit adapted to direct to the blast furnace the oxygen produced by the separation apparatus, is characterized in that the air separation apparatus is a distillation apparatus which comprises a mixing column operating under a higher pressure, particularly by about 1 bar, than the output pressure of the blower, this mixing column being supplied at its head with liquid oxygen and at its base with air and said enriching conduit leaving the top of this column.

Figure 2:
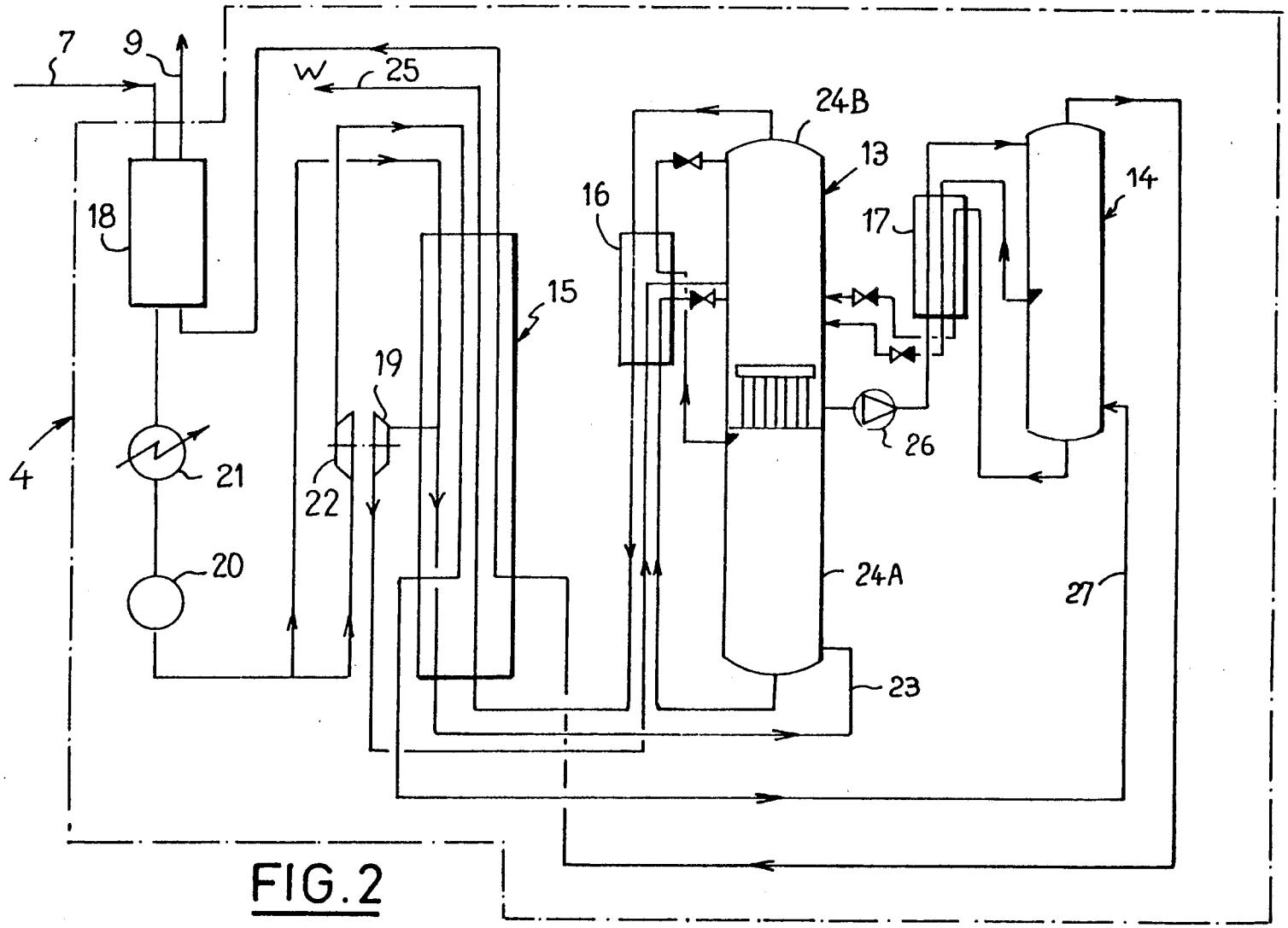

An example of application of the invention will now be described with respect to the accompanying drawings, in which:

FIG. 1 shows schematically an installation for the reduction of iron ore according to the invention; and FIG. 2 shows schematically an air distillation apparatus used in this installation.

There is shown in FIG. 1 an installation for the reduction of iron ore comprising a blast furnace 1 provided with air preheating apparatus or Cowpers 2, two blowers 3 mounted in parallel and with an air distillation apparatus 4.

The blowers 3 deliver air under about 6 bars absolute into the same delivery conduit 5 leading to the Cowpers 2. An injection conduit 6 connecting the latter to the air tuyeres (not shown) of the blast furnace completes the principal air circuit of the installation.

The distillation apparatus 4 is arranged as a detour from the air circuit 5, 6. It is fed by a conduit 7 branched from conduit 5 and provided with a flow regulating valve 8, and produces impure oxygen (which will be designated for simplicity by the word "oxygen") via an oxygen or enrichment conduit 9. As shown, this conduit 9 can feed either into the conduit 5, and thus upstream of the Cowpers, via a conduit 10, or into the conduit 6, which is to say downstream of the Cowpers, via a conduit 11, or directly into the oxygen tuyeres (not shown) of the blast furnace, via a conduit 12.

There is shown in FIG. 1 three conduits 10 to 12, each provided with a valve, to permit use of the product oxygen by the apparatus 4 in an optimum manner in each instance of operation. In particular, the conduit 10 is utilized only if the oxygen content of the enriched air supplied by conduit 6 is less than 30%, for safety purposes.

The distillation apparatus 4 can be a simple double column apparatus producing the impure oxygen at a pressure about atmospheric, this oxygen being compressed to the desired pressure for introduction into the tuyeres, either at about 6 bars, by a compressor if it is produced in gaseous phase, or by a pump if it is produced in a liquid phase.

The apparatus 4 could also be adapted to produce directly the impure oxygen under pressure, according to the process described in U.S. Pat. No. 4,022,030. The apparatus 4 shown in FIG. 2 is essentially the same as that shown in FIG. 8 of this American patent, which is to say that it comprises a double distillation column 13, a mixing column 14, a principal heat exchanger 15, auxiliary heat exchangers 16, 17, 18, and a turbine 19 for expanding to low pressure a portion of the entering air, this turbine serving to cool the apparatus 4. There is also shown a unit 20 for purification by adsorption of the entering air, preceded by a water cooling device 21.

The apparatus 4 differs however from that shown in FIG. 8 of the above U.S. patent, by the fact that the air flow sent to the mixing column 14, is supercharged by about 1 bar by the auxiliary blower 22 coupled to the turbine 19. The liquid oxygen sent to the head of column 14 is therefore compressed to about 7 bars, and this permits compensating the pressure losses to obtain in conduit 10, 11 or 12 (FIG. 1) oxygen at the same pressure as the air flowing in the air circuit 5, 6.

More exactly, the air arriving by conduit 7, precooled at 18, cooled to ambient temperature at 21 and purified at 20, is divided into two flows, of which a first, typically comprising about 75% of the total air flow, is partially cooled in the exchanger 15. A fraction of this air is further cooled to about its dew point and is introduced via conduit 23 to the base of the medium pressure column 24A of the double column, which produces two fluids: at the head of the low pressure column 24B, impure nitrogen constituting a residual gas W and evacuated after reheating via a conduit 25; and at the base of column 24B, liquid oxygen compressed to about 7 bars by a pump 26 and sent to the head of column 14.

The remaining fraction of the first purified air flow is, after its partial cooling, removed from exchanger 15, expanded to low pressure in the turbine 19 and blown into the column 24B. The energy produced by this turbine serves to drive the blower 22, which supercharges to 7 bars the remaining air flow leaving the purifying device 20. This super-charged air, after cooling in the exchanger to the vicinity of its dew point, is introduced via a conduit 27 to the base of column 14.

Column 14 produces at its head, under about 7 bars, the desired impure oxygen, which can have a purity between 35% and 95%, this purity being easily regulable by regulation of the double column 13. This oxygen, after reheating in the exchanger 15 and then in the exchanger 18, is evacuated from the apparatus 4 via conduit 9.

The air distillation apparatus having an excellent extraction output, there is obtained at the tuyeres of the blast furnace a total oxygen flow substantially equal to that which has been compressed by the blowers 3 of the blast furnace, but with a variable oxygen content depending on the quantity of air which has flowed through the apparatus 4, this latter thus performing the function of removing nitrogen from the air.

Thus, the blast furnace 1 can operate either according to its conventional configuration, as to the air, or, according to the size of the flow detoured through the air separation apparatus, with air that is more or less enriched. The detoured flow can vary within relatively wide limits, according to the adaptability of the distillation apparatus 4.

It will be noted that with the apparatus 4 having blower 22 shown in FIG. 2, the production of oxygen under the pressure of the blast furnace requires no additional expenditure of energy relative to the conventional blast furnace, because the compressed oxygen is produced directly from the air leaving the blast furnace blower without any additional expenditure of energy.

Moreover, by using simultaneously two blowers 3 normally provided for the blast furnace, there can be introduced into this latter a substantially increased flow of air enriched in oxygen, thereby to obtain higher output of the blast furnace.

Preferably, there is connected to the installation a reservoir 28 of liquid oxygen (FIG. 1). One can thus, in case of malfunction of the distillation apparatus, progressively revert to the conventional operation of the blast furnace with air, after a transitional phase in which the necessary oxygen is provided by the reservoir 28.

What is claimed is:

1. A method of supplying a blast furnace with air and oxygen, wherein the oxygen is produced by an air separation apparatus comprising a combination of a double column and a mixing column, the method comprising the steps of:

compressing a feed flow of air to a first pressure;

dividing the feed flow into a first flow and a second flow;

sending said first flow to a said blast furnace at said first pressure;

sending said second flow to said air separation apparatus at said first pressure; and operating the mixing column at a second pressure higher than said first pressure to produce gaseous oxygen at said second pressure for supplying to the blast furnace.

2. The method of claim 1, further comprising:

dividing said second flow into a third flow and a fourth flow;

sending said third flow at said first pressure to said double column; and compressing said fourth flow to said second pressure for supplying the mixing column.

3. The method of claim 2, further comprising:

removing liquid oxygen from said double column; and compressing the removed liquid oxygen to said second pressure for supplying the mixing column.

4. The method of claim 2, and providing the energy for compressing the fourth flow by expanding isentropically part of said third flow.

5. The method of claim 2, and supplying said gaseous oxygen directly to the blast furnace.

6. The method of claim 1, and admixing said gaseous oxygen with said first flow of air at said first pressure.

7. A plant for the reduction of iron ore, comprising in combination a blast furnace and an air separation apparatus including a double column having a liquid oxygen outlet connected to a mixing column having an air inlet and a gaseous oxygen outlet, at least one blower supplying a first air conduit leading to the blast furnace and a second air conduit leading to the double column, an air conduit branched from the second air conduit and leading to said air inlet of the mixing column, a compressor in said branched conduit, and a gaseous oxygen conduit leading from the gaseous oxygen outlet of the mixing column to the blast furnace.

8. The plant of claim 7, further comprising a cooling turbine for expanding part of the air in the second air conduit and drivingly coupled to the compressor in the branched air conduit.

9. The plant of claim 7, further comprising a liquid oxygen conduit including a pump leading from the liquid oxygen outlet of the double column to the mixing column.

10. The plant of claim 7, wherein said gaseous oxygen conduit opens into the blast furnace.

* * * * *